US005685156A

United States Patent [19]

Willis et al.

[11] Patent Number: 5,685,156

[45] Date of Patent: Nov. 11, 1997

[54] CATALYTIC COMBUSTION SYSTEM

[75] Inventors: Jeffrey W. Willis, Los Angeles; James E. Belmont, Canoga Park, both of Calif.

[73] Assignee: Capstone Turbine Corporation, Tarzana, Calif.

[21] Appl. No.: 650,625

[22] Filed: May 20, 1996

[51] Int. Cl.[6] ..... F02C 1/00

[52] U.S. Cl. ..... 60/723; 60/39.511; 60/760

[58] Field of Search ..... 60/39.511, 723, 60/754, 760, 39.32; 431/2, 6, 7, 12, 170

[56] References Cited

U.S. PATENT DOCUMENTS

| | | | |
|---|---|---|---|
| 2,829,494 | 4/1958 | Christensen . | |
| 3,691,762 | 9/1972 | Ryberg et al. . | |
| 3,765,171 | 10/1973 | Hagen et al. | 60/39.511 |
| 3,797,231 | 3/1974 | McLean . | |
| 3,846,979 | 11/1974 | Pfefferle . | |
| 3,895,488 | 7/1975 | Koch . | |
| 3,973,390 | 8/1976 | Jeroszko . | |
| 4,019,316 | 4/1977 | Pfefferle . | |
| 4,040,252 | 8/1977 | Mosier et al. . | |
| 4,065,917 | 1/1978 | Pfefferle . | |
| 4,112,675 | 9/1978 | Pillsbury et al. | 431/6 |
| 4,118,171 | 10/1978 | Flanagan et al. . | |
| 4,285,193 | 8/1981 | Shaw et al. . | |
| 4,433,540 | 2/1984 | Cornelius et al. . | |
| 4,509,333 | 4/1985 | Nussdorfer et al. . | |
| 4,726,181 | 2/1988 | Pillsbury . | |
| 4,787,208 | 11/1988 | DeCorso . | |
| 5,000,004 | 3/1991 | Yamanaka et al. | 431/7 |
| 5,079,911 | 1/1992 | Kumakura | 60/39.511 |
| 5,161,366 | 11/1992 | Beebe . | |
| 5,412,938 | 5/1995 | Keller . | |
| 5,440,872 | 8/1995 | Pfefferle . | |
| 5,452,574 | 9/1995 | Cowell et al. . | |

*Primary Examiner*—Charles G. Freay
*Attorney, Agent, or Firm*—Albert J. Miller

[57] ABSTRACT

The present invention is directed to a catalytic combustion system having a gas turbine engine recuperator and an annular catalytic combustor. The annular catalytic combustor includes a pre-burner/pre-mixer which functions as a pre-burner during startup and as a pre-mixer for the fuel and air during catalytic operation. This pre-burner/pre-mixer includes a plurality of primary tangential air-fuel venturis each having a fuel injector, and a plurality of secondary tangential air dilution holes. The pre-burner/pre-mixer is joined to the annular in-line catalytic canister by a transition section which includes a plurality of tertiary air dilution holes which introduce air radially into the transition section from the inner liner thereof. The in-line annular catalyst canister includes a large plurality of microlith catalyst elements positioned between support tings and held at the open end thereof by a plurality of support spokes.

18 Claims, 2 Drawing Sheets

CATALYTIC COMBUSTION SYSTEM

TECHNICAL FIELD

This invention relates to the general field of combustors for gas turbine engines and more particularly to an improved dual in-line catalytic combustion system.

BACKGROUND OF THE INVENTION

In a gas turbine engine, inlet air is continuously compressed, mixed with fuel in an inflammable proportion, and then contacted with an ignition source to ignite the mixture which will then continue to burn. The heat energy thus released then flows in the combustion gases to a turbine where it is converted to rotary energy for driving equipment such as an electrical generator. The combustion gases are then exhausted to atmosphere after giving up some of their remaining heat to the incoming air provided from the compressor.

Quantities of air greatly in excess of stoichiometric amounts are normally compressed and utilized to keep the combustor liner cool and dilute the combustor exhaust gases so as to avoid damage to the turbine nozzle and blades. Generally, primary sections of the combustor are operated near stoichiometric conditions which produce combustor gas temperatures up to approximately four thousand (4,000) degrees Fahrenheit. Further along the combustor, secondary air is admitted which raises the air-fuel ratio and lowers the gas temperatures so that the gases exiting the combustor are in the range of two thousand (2,000) degrees Fahrenheit. The fuel injection pressure can vary and is typically six hundred (600) PSI for full power and as low as sixty (60) PSI to one hundred (100) PSI for idle conditions.

It is well established that NOx formation is thermodynamically favored at high temperatures. Since the NOx formation reaction is so highly temperature dependent, decreasing the peak combustion temperature can provide an effective means of reducing NOx emissions from gas turbine engines as can limiting the residence time of the combustion products in the combustion zone. Operating the combustion process in a very lean condition (i.e., high excess air) is one of the simplest ways of achieving lower temperatures and hence lower NOx emissions. Very lean ignition and combustion, however, inevitably result in incomplete combustion and the attendant emissions which result therefrom. In addition, combustion processes cannot be sustained at these extremely lean operating conditions.

Lean ignition and incomplete combustion have also been encountered in internal combustion engines and catalysts have been utilized to promote and complete the combustion process. The catalytic converters on automobiles are a classic example of post combustion treatment of the combustion products to remove undesirable emissions such as NOx, CO and HC. It would not be correct, however, to consider these catalytic converters as combustors.

In a catalytic combustor, fuel is burned at relatively low temperatures in the range of from several hundred degrees Fahrenheit to approximately two thousand (2,000) degrees Fahrenheit. While emissions can be reduced by combustion at these temperatures, the utilization of catalytic combustion has been limited by the amount of catalytic surface required to achieve the desired reaction and the attendant undesirable pressure drop across the catalytic surface. Also, the time to bring the catalytic combustor up to operating temperature continues to be of concern.

SUMMARY OF THE INVENTION

The present invention is directed to a catalytic combustion system having a gas turbine engine recuperator and an annular catalytic combustor. The annular catalytic combustor includes a pre-burner/pre-mixer which functions as a pre-burner during startup and as a pre-mixer for the fuel and air during catalytic operation. This pre-burner/pre-mixer includes a plurality of primary tangential air-fuel venturis each having a fuel injector, and a plurality of secondary tangential air dilution holes.

The pre-burner/pre-mixer delivers combustion products to an annular in-line catalytic canister during startup and pre-mixed air and fuel during catalytic operation. The pre-burner/pre-mixer is joined to the annular in-line catalytic canister by a transition section which includes a plurality of tertiary air dilution holes which introduce air radially into the transition section from the inner liner thereof.

The in-line annular catalyst canister includes a large plurality of microlith catalyst elements positioned between support rings and held at the open end thereof by a plurality of support spokes. Inner and outer annular air gaps may be provided around the microlith catalyst elements.

BRIEF DESCRIPTION OF THE DRAWINGS

Figure 1:
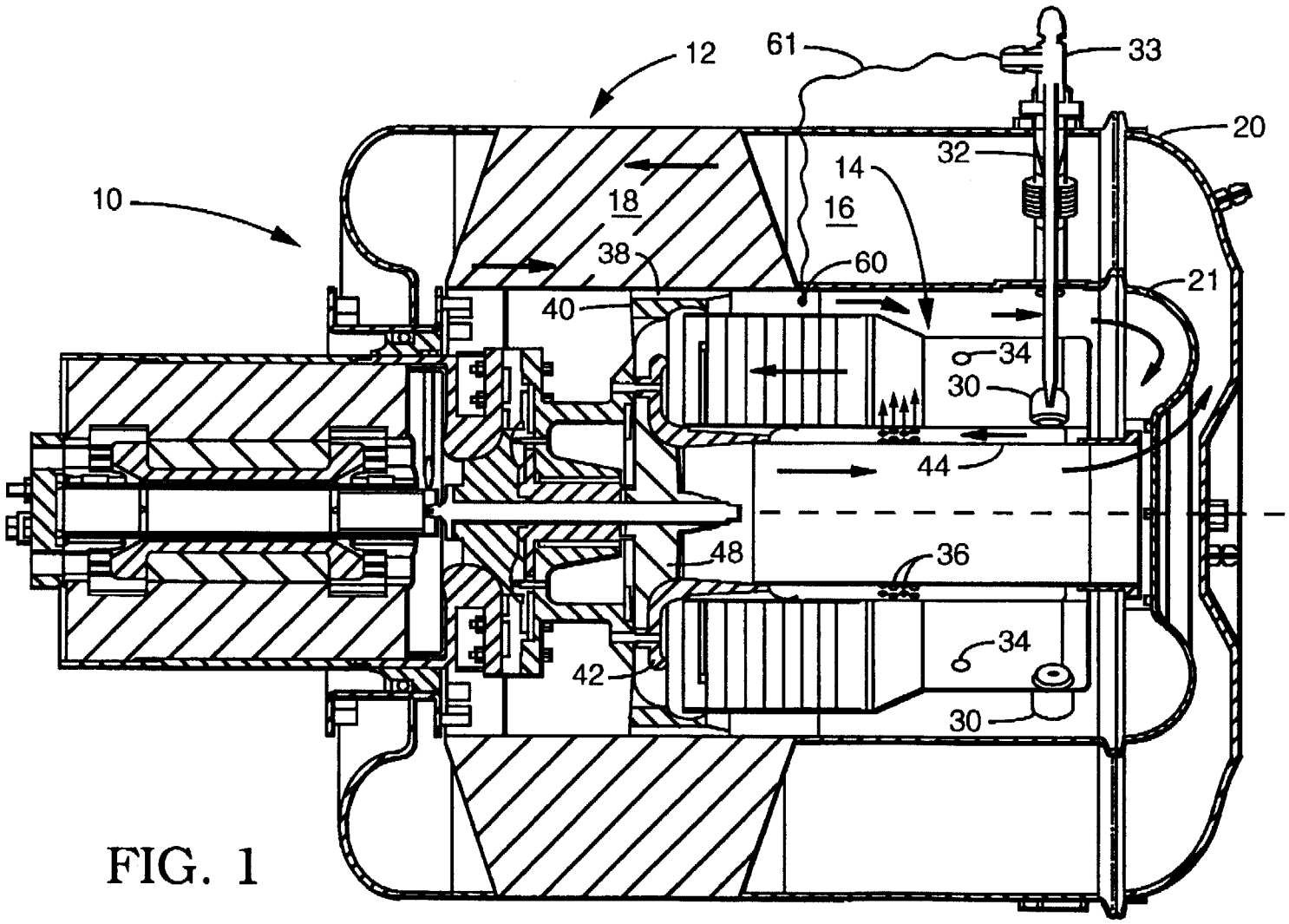
Figure 3:
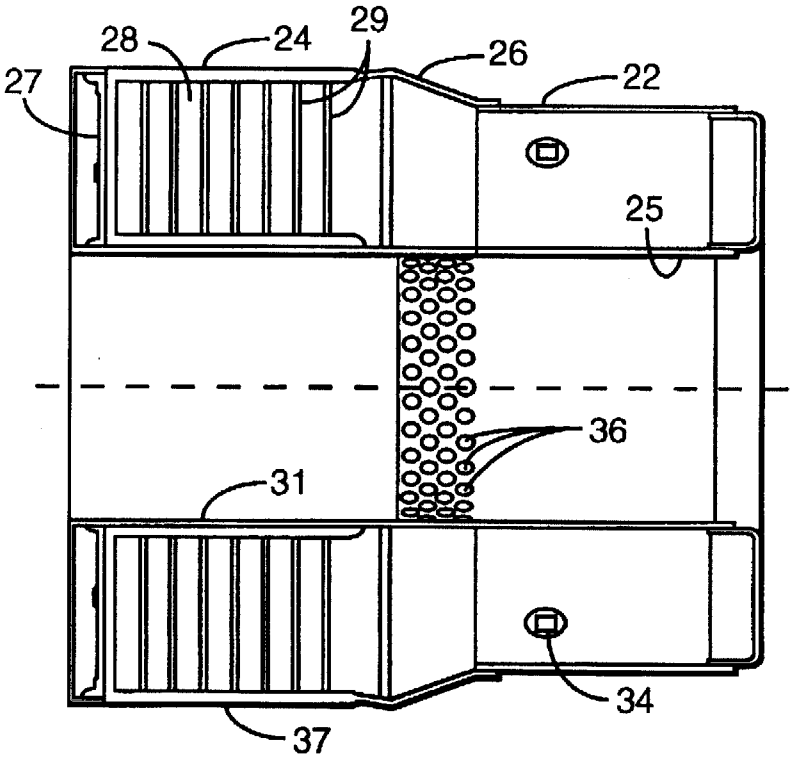
Figure 2:
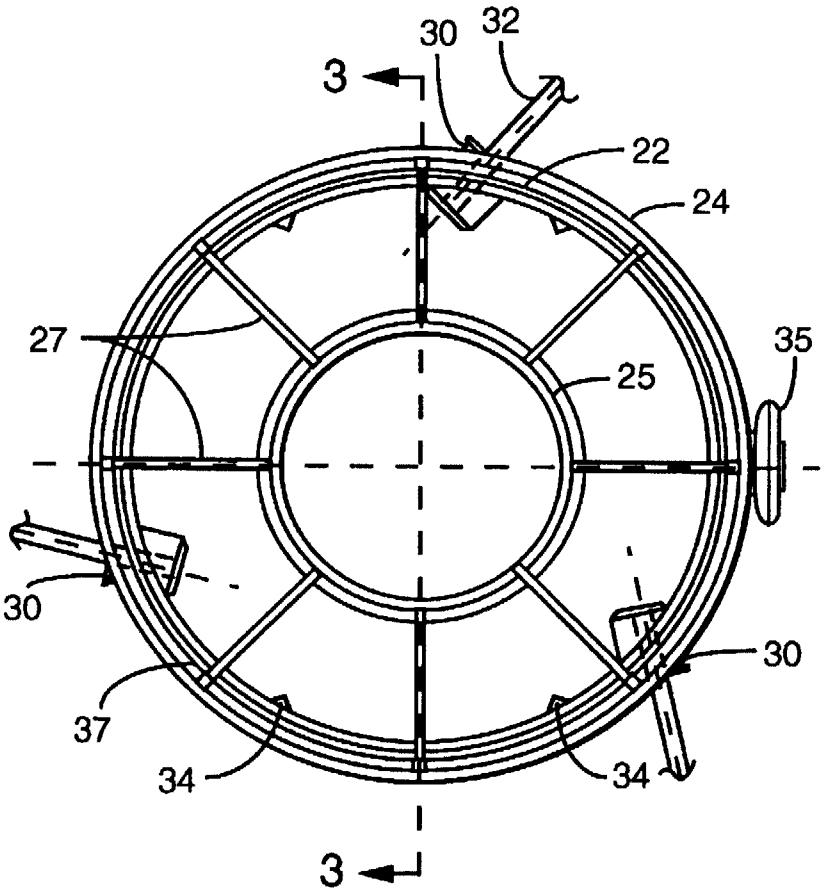

Having thus described the present invention in general terms, reference will now be made to the accompanying drawings in which:

FIG. 1 is a cut away plan view of a gas turbine engine utilizing the catalytic combustion system of the present invention;

FIG. 2 is an end view of the catalytic combustor used in the catalytic combustion system of FIG. 1; and FIG. 3 is a cross-sectional view of the catalytic combustor of FIG. 2 taken along line 3—3.

DETAILED DESCRIPTION OF THE PREFERRED EMBODIMENTS

The catalytic combustion system 10 of the present invention, illustrated in FIG. 1, generally comprises a gas turbine engine recuperator 12 and an annular catalytic combustor 14. The gas turbine engine recuperator 12 includes an annular passageway 16 having a heat transfer section 18, exhaust gas dome 20, and combustor plenum dome 21.

The annular catalytic combustor 14, also shown separately in FIGS. 2 and 3, includes a pre-burner/pre-mixer 22 and a catalyst canister 24. Both the annular pre-burner/pre-mixer 22 and annular catalyst canister 24 share the same diameter inner liner 25. The outer diameter of the annular pre-burner/pre-mixer 22 is, however, smaller than the outer diameter of the in-line annular catalyst canister 24 and the two are joined by a transition section 26.

The catalyst canister 24 includes a plurality (shown for purposes of illustration only as eight (8)) support tings 29 disposed within the catalyst canister 24 and supported at the open or downstream end of the catalyst canister 24 by a plurality of support spokes 27 (also shown for purposes of illustration only as eight (8)).

The large plurality of microlith catalyst elements 28, as many as one hundred-twenty (120), are disposed amongst the plurality of support rings 29 in the catalyst canister 24. These microlith catalyst elements 28 have high open area with flow paths so short that reaction rate per unit length per channel is at least fifty percent (50%) higher than for the same diameter channel having fully developed boundary layer in laminar flow. These microlith catalyst elements 28 may be in the form of woven wire screens, pressed metal or wire screens and have as many as 100 to 1000 or more flow channels per square centimeter. The flow channels may be of any desired shape and for wire screens the flow channel length would be the wire diameter and thus advantageously may be shorter than 0.3 mm or even shorter than 0.1 mm. The screens provide a large surface area, promote turbulence, and prevent the formation of boundary layers. The catalyst material may be a precious metal which can be sputtered on the catalyst elements 28 of the microlith catalyst. An inner annular air gap 31 and an outer annular air gap 37 may be provided to insulate the microlith catalyst elements 28.

The pre-burner/pre-mixer 22 includes a plurality (shown as three) of primary tangential air-fuel venturis 30 generally equally spaced around the outer periphery of the pre-burner/pre-mixer 22 near the combustor plenum dome end of the pre-burner/pre-mixer 22. Each primary air-fuel venturi 30 includes a fuel injector 32. A fuel control valve 33 may be provided with each fuel injector or, alternately, a single fuel control valve 33 can be utilized to collectively control the flow of fuel through the three (3) fuel injectors 32. An air temperature thermocouple 60 is located near the inner wall of the gas turbine recuperator and includes an operable connection 61 to the fuel control valve(s). In addition, a fuel igniter 35 is provided.

Near the transition section end of the pre-burner/pre-mixer 22, the outer periphery of the pre-burner/pre-mixer 22 includes a plurality of secondary tangential air dilution holes 34 generally spaced around the periphery of the pre-burner/pre-mixer 22. While axially displaced downstream from the primary tangential air-fuel venturis 30, a pair of secondary tangential air dilution holes 34 can generally be equally peripherally spaced on either side of each primary tangential air-fuel venturi 30. While FIGS. 1 and 3 best illustrate the axial positions of the primary tangential air-fuel venturis 30 and secondary tangential air dilution holes 34, the circumferential relationship between the primary tangential air-fuel venturis 30 and the tangential secondary air dilution holes 34 is best shown in FIG. 2.

A large plurality of tertiary air dilution holes 36 are disposed in the combustor inner liner 25 of the transition section 26 of the annular catalytic combustor 14. A combustor seal 38, combustor shroud 40 and turbine nozzle 42 are provided between the catalytic combustor 14 and the turbine 48. A turbine exhaust robe 44 extends from the turbine 48 through the interior of the combustor inner liner 25 to the exhaust gas dome 20.

In operation, the incoming air temperature is raised to the catalyst operating temperature by the gas turbine engine recuperator 12 between the turbine exhaust gas and the compressor discharge gas. After leaving one side of the heat exchange section 18 of the gas turbine engine recuperator 12, the air enters the space between the annular recuperator passageway 16 and the catalyst canister 24 of the catalytic combustor 14, proceeds over the transition section 26 to around the pre-burner/pre-mixer 22. A portion of this air flows through the primary tangential air-fuel venturis 30 and the tangential secondary air dilution holes 34. By way of example, about three percent (3%) of this airflow would go to the primary tangential air-fuel venturis 30 while about seven percent (7%) would go to the tangential secondary air dilution holes 34. About eighty percent (80%), the remainder after leakage, is directed by the combustor plenum dome 21 to the space between the turbine exhaust tube 44 and the combustor inner liner 25 of the pre-burner/pre-mixer 22 from where it is directed into the transition section 26 through tertiary air dilution holes 36.

When fuel is supplied to the fuel injectors 32 of the primary tangential air-fuel venturis 30 and mixed with the primary air flow during pre-burner operation, this air-fuel mixture can be ignited by the igniter 35. The amount of fuel can be controlled by the fuel valve(s) 33 and its pressure can be regulated by a fuel pump (not shown). Secondary air is admired around the periphery of the pre-burner/pre-mixer 22 through tangential secondary air dilution holes 34 to complete the combustion process and to reduce the temperature within the pre-burner/pre-mixer 22. The radially outward directed air flow from the tertiary air dilution holes 36 in the combustor inner liner 25 of the transition section 26 further achieves this result before the catalyst canister 24.

During the start up procedure, the pre-burner/pre-mixer 22 functions as a pre-burner to initially heat up the microlith catalyst elements 28 in catalyst canister 24 and to also heat up the gas turbine engine recuperator 12. Once the temperature of the air going into the catalytic combustor 14 reaches a temperature over nine hundred (900) degrees Fahrenheit, measured by the air temperature thermocouple 60, the fuel to the primary tangential air-fuel venturis 30 is pulsed off causing the combustion flame to be quenched or extinguished. At this air temperature, the temperature of the catalyst will have reached approximately one thousand four hundred (1,400) degrees Fahrenheit, well above the light-off temperature of the microlith catalyst elements 28. When the flow of fuel is restarted, the pre-burner/pre-mixer 22 then functions as a pre-mixer to completely vaporize and pre-mix the air and fuel. When the heated air-fuel mixture impinges upon the heated microlith catalyst elements 28, ignition of the fuel occurs and catalytic combustion is sustained to continue the operation of the system.

This catalytic combustion system 10 is capable of achieving near-zero emission levels due to its extremely low combustion temperature during catalytic operation. Complete combustion can be sustained at the extremely low equivalence ratios present. While there may be relatively high NOx production while the pre-burner 22 is operated during system start up, any CO and HC will be scrubbed by the catalyst 28 in the catalyst canister 24. This scrubbing effect will occur within a couple of seconds of light-off in the pre-burner. Once the flame in the pre-burner 22 is quenched, it now functions as a pre-mixer and pre-vaporizer for the air-fuel mixture which goes to the microlith catalyst elements 28. Once catalytic combustion is established in the catalytic canister 24, there will be very low NOx production and low CO and HC production over a wide range of operating conditions. The levels are low enough to qualify for use in an Equivalent Zero Emissions Vehicle (EZEV) under proposed State of California legislation.

During catalytic operation, the air-fuel mixture must be well mixed and completely vaporized. The tangential injection of the primary air-fuel mixture and the tangential injection of the secondary dilution air promotes mixing of the air and fuel and enhances the stability of the primary combustion zone. Tangential injection increases the residence time of the mixture in the pre-burner/pre-mixer 22 while maintaining a relatively short section length. This long residence time insures that the fuel droplets will be completely vaporized and well mixed long before they impinge upon the catalyst surface. The dilution system of tangential secondary air and radially outwardly introduced tertiary air is optimized to increase the mixing of the air and fuel and prevent auto-ignition from occurring in the pre-mixer during catalytic combustion in the catalyst canister 24. Auto-ignition would cause a flame to be sustained within the pre-mixer resulting in significantly increased NOx emissions.

As in any catalytic combustion system, the catalyst itself is the limiting factor. The catalyst requires a minimum light-off temperature before the catalyst becomes operational. The performance of the pre-mixer 22 is critical during catalytic operation of the combustion system. Poor mixing or incomplete vaporization of the fuel can result in significantly increased emissions or even destruction of the catalyst material. For optimal emissions, near perfect mixing of the air and fuel is required. The dual function pre- burner/pre-mixer 22 performs as an efficient pre-mixer to provide near perfect pre-mixing while avoiding auto-ignition during catalytic operation. Prior to catalytic operation, the pre-burner/pre-mixer 22 functions as an acceptable pre-burner.

This dual functionality is achieved in a system with no variable geometry or multiple types of fuel injectors. All of the air that enters the catalytic combustion system is provided through fixed orifices. The only control of air flow is turbine speed. The flow and pressure of the fuel is, however, controlled.

While specific embodiments of the invention have been illustrated and described, it is to be understood that these are provided by way of example only and that the invention is not to be construed as being limited thereto but only by the proper scope of the following claims.

What we claim is:

1. A catalytic combustion system for a recuperated gas turbine engine, comprising:

an annular catalyst canister including a plurality of catalyst elements;

an annular pre-burner/pre-mixer axially in line with said annular catalyst canister to supply combustion products to said annular catalyst canister during system startup and a vaporized fuel-air mixture to said annular catalyst canister during catalytic system operation, said annular pre-burner/pre-mixer including near a closed end thereof a plurality of primary tangential air-fuel venturis each having a fuel injector, and a plurality of secondary tangential air dilution holes downstream from said plurality of primary tangential air-fuel venturis; and an annular transition section connecting said annular pre-burner/pre-mixer to said annular catalyst canister, the inner diameter of said annular transition section including a plurality of tertiary air dilution holes.

2. The catalytic combustion system of claim 1 and in addition, means operably associated with said fuel injectors to pulse off the flow of fuel to quench the combustion flame in said annular pre-burner/pre-mixer once the light-off temperature of the catalyst elements is reached.

3. The catalytic combustion system of claim 1 wherein said annular pre-burner/pre-mixer has a smaller outer diameter than said annular catalyst canister.

4. A catalytic combustion system, comprising:

a gas turbine engine including a compressor, a turbine, and a recuperator;

an annular pre-burner/pre-mixer to receive heated compressed air from said gas turbine engine recuperator, said annular pre-burner/pre-mixer including near a closed end thereof a plurality of primary tangential air-fuel venturis each having a fuel injector, and a plurality of secondary tangential air dilution holes downstream from said plurality of primary tangential air-fuel venturis;

an annular catalyst canister axially in-line with said annular pre-burner/pre-mixer and including a plurality of microlith catalyst elements; and an annular transition section connecting said annular pre-burner/pre-mixer to said annular catalyst canister, the inner diameter of said annular transition section including a plurality of tertiary air dilution holes, said annular pre-burner/pre-mixer to supply combustion products to said annular catalyst canister during system startup and a vaporized fuel-air mixture to said annular catalyst canister during catalytic system operation when said catalyst canister supplies combustion products to said turbine of said gas turbine engine.

5. The catalytic combustion system of claim 4 and in addition, means operably associated with said fuel injectors to pulse off the flow of fuel to quench the combustion flame in said annular pre-burner/pre-mixer once the light-off temperature of the catalyst elements is reached.

6. The catalytic combustion system of claim 4 wherein said annular catalyst canister has an outer diameter greater than said annular pre-burner/pre-mixer.

7. A catalytic combustion system, comprising:

a gas turbine engine including a compressor and a turbine on a common shaft, and a recuperator heating the incoming air from said compressor with exhaust gases from said turbine, said turbine including a turbine exhaust tube;

an inner liner disposed around said turbine exhaust tube; an annular catalyst canister formed around the turbine end of said inner liner, said catalyst canister including a plurality of microlith catalyst elements;

an annular pre-burner/pre-mixer formed around the other end of said inner liner to receive heated compressed air from said recuperator, said annular pre-burner/pre-mixer having a smaller outer diameter than said annular catalyst canister and including near a closed end thereof a plurality of primary tangential air-fuel venturis each having a fuel injector, a plurality of secondary tangential air dilution holes downstream from said plurality of primary tangential air-fuel venturis, and an ignitor at the closed end thereof; and an annular transition section formed around the central portion of said inner liner to join said annular pre-burner/pre-mixer with said annular catalyst canister, the inner liner of said annular transition section including a plurality of tertiary radial air dilution holes, said annular pre-burner/pre-mixer to supply combustion products to said annular catalyst canister during system startup and a vaporized fuel-air mixture to said annular catalyst canister during catalytic system operation when said catalyst canister supplies combustion products to said turbine of said gas turbine engine.

8. The catalytic combustion system of claim 7 wherein said gas turbine engine recuperator is disposed around said turbine and compressor and said annular catalyst canister, said transition section and said annular pre-burner/pre-mixer, and the heated compressed air from said gas turbine recuperator passes over the annular catalyst canister, said annular transition section and said annular pre-burner/pre-mixer before being directed between said inner liner and said turbine exhaust tube.

9. The catalytic combustion system of claim 8 wherein approximately three percent of the heated compressed air from said recuperator is provided to said secondary tangential air dilution holes, approximately seven percent is provided to said primary tangential air-fuel venturis, and the remainder is provided to said tertiary air dilution holes.

10. The catalytic combustion system of claim 7 wherein said fuel injectors include means to pulse off the flow of fuel to quench the combustion flame in said annular pre- burner/pre-mixer once the light-off temperature of the catalyst elements is reached.

11. The catalytic combustion system of claim 7 wherein said means to pulse off the flow of fuel comprises a fuel control valve activated by a thermocouple disposed between said gas turbine recuperator and said annular catalytic canister.

12. The catalytic combustion system of claim 7 wherein said plurality of primary tangential air-fuel venturis is three.

13. The catalytic combustion system of claim 7 wherein said plurality of secondary tangential air dilution holes is six.

14. The catalytic combustion system of claim 7 wherein said plurality of tertiary radial air dilution holes is over one hundred.

15. The catalytic combustion system of claim 14 wherein said plurality of tertiary radial air dilution holes are in a plurality of rows.

16. The catalytic combustion system of claim 14 wherein said plurality of rows is four.

17. The catalytic combustion system of claim 7 wherein said plurality of primary tangential air-fuel venturis is three, said plurality of secondary tangential air dilution holes is six, and said plurality of tertiary radial air dilution holes is over one hundred in four rows.

18. The catalytic combustion system of claim 7 wherein said plurality of microlith catalyst elements is over one hundred and slidably supported within said catalyst canister amongst a plurality of support disks and held in place in said catalyst canister by support spokes at an end of said catalyst canister.

* * * * *

UNITED STATES PATENT AND TRADEMARK OFFICE

CERTIFICATE OF CORRECTION

PATENT NO. : 5,685,156

DATED : November 11, 1997

INVENTOR(S) : Jeffrey W. Willis and James E. Belmont

It is certified that error appears in the above-indentified patent and that said Letters Patent is hereby corrected as shown below:

ABTSRACT, line 15, change "tings" to --rings--
Column 2, line 53, change "tings" to --rings--
Column 3, line 44, change "robe" to --tube--
Column 4, line 5, change "admired" to --admitted--
Claim 1, line 10, change "a" to --the--
Claim 4, line 6, change "a" to --the--
Claim 7, line 15, change "a" to --the--

Signed and Sealed this

Seventeenth Day of February, 1998

*Attest:*

Bruce Lehman

BRUCE LEHMAN

*Attesting Officer*

*Commissioner of Patents and Trademarks*